US009546668B2

(12) United States Patent
Lyons

(10) Patent No.: US 9,546,668 B2
(45) **Date of Patent: *Jan. 17, 2017**

(54) EXTENDED LENGTH CUTOFF BLOWER

(71) Applicant: Regal Beloit America, Inc., Beloit, WI (US)

(72) Inventor: Leslie A. Lyons, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 613 days.

This patent is subject to a terminal disclaimer.

(21) Appl. No.: 14/056,589

(22) Filed: Oct. 17, 2013

(65) Prior Publication Data

US 2014/0050598 A1 Feb. 20, 2014

Related U.S. Application Data

(63) Continuation of application No. 13/082,683, filed on Apr. 8, 2011, now Pat. No. 8,591,183, which is a continuation-in-part of application No. 12/099,384, filed on Apr. 8, 2008, now abandoned.

(60) Provisional application No. 60/943,955, filed on Jun. 14, 2007.

(51) Int. Cl.
*F04D 29/42* (2006.01)
*F04B 17/00* (2006.01)

(52) U.S. Cl.
CPC ..... *F04D 29/4226* (2013.01); *F04B 17/00* (2013.01)

(58) Field of Classification Search
CPC ..... F04D 29/4226; F04B 17/00
USPC ..... 415/206, 204, 212.1
See application file for complete search history.

(56) References Cited

U.S. PATENT DOCUMENTS

| | | | | |
|---|---|---|---|---|
| 17,664 | A | 6/1857 | Braugh | |
| 82,736 | A | 10/1868 | Mitchell | |
| 236,804 | A | 1/1881 | Green et al. | |
| 662,395 | A | 11/1900 | Davidson | |
| 675,375 | A | 6/1901 | Davidson | |
| 801,304 | A * | 10/1905 | Davidson | F04D 29/4226 415/204 |
| 839,273 | A | 12/1906 | Davidson | |

(Continued)

FOREIGN PATENT DOCUMENTS

| | | | |
|---|---|---|---|
| CA | 2314532 | A1 | 2/2001 |
| DE | 19709193 | A1 | 10/1997 |

(Continued)

OTHER PUBLICATIONS

JP 61-138900 A Translation. FLS, Inc. Washington, D.C., Sep. 2010. pp. 1-10.
U.S. Appl. No. 60/943,955, filed Jun. 14, 2007 (Lyons).

*Primary Examiner* — Richard Edgar
(74) *Attorney, Agent, or Firm* — Thompson Coburn LLP

(57) ABSTRACT

A blower assembly including a blower housing having a side wall with a first portion extending from the initial cutoff through an angle of at least 45° or more, the first portion having a radius which is substantially constant or which increases at a relatively small rate. The side wall additionally includes a second portion, extending from the end of the first portion to the outlet, which forms a continuous curve with the first portion and has an increasing radius which is increasing at a larger rate and has a rate of increase that is also increasing with housing angle. The shape of the side wall allows a reduction in the overall size of the blower housing for a given size of impeller.

19 Claims, 7 Drawing Sheets

(56) References Cited

U.S. PATENT DOCUMENTS

| | | | | |
|---|---|---|---|---|
| 866,887 | A | | 9/1907 | Robinson |
| RE12,796 | E | | 5/1908 | Davidson |
| RE12,797 | E | | 5/1908 | Davidson |
| RE12,798 | E | | 5/1908 | Davidson |
| 1,031,180 | A | | 7/1912 | Hancock |
| 1,111,250 | A | | 9/1914 | Davidson |
| 1,138,083 | A | | 5/1915 | Carrier |
| 1,282,065 | A | | 10/1918 | Froelich |
| 1,462,557 | A | | 7/1923 | Kuenzel, Jr. |
| 1,637,652 | A | | 8/1927 | Ness |
| 1,875,881 | A | | 9/1932 | Morse |
| 1,877,905 | A | | 9/1932 | le Grand |
| 1,892,930 | A | | 1/1933 | Burman |
| 1,895,488 | A | | 1/1933 | Reisinger |
| 1,935,120 | A | | 11/1933 | Hagen |
| 2,083,996 | A | | 6/1937 | Jonn |
| 2,155,631 | A | | 4/1939 | Anderson |
| 2,165,069 | A | | 7/1939 | Reynolds |
| 2,225,398 | A | | 12/1940 | Hamblin |
| 2,301,857 | A | | 11/1942 | Criqui |
| 2,322,357 | A | | 6/1943 | Hagen |
| 2,441,411 | A | | 5/1948 | Hagen |
| 2,564,775 | A | | 8/1951 | Besser |
| 3,098,603 | A | | 7/1963 | Baker |
| 3,154,242 | A | | 10/1964 | Harris |
| 3,191,851 | A | | 6/1965 | Wood |
| 3,227,150 | A | | 1/1966 | Reznick et al. |
| 3,275,223 | A | | 9/1966 | Fowell |
| 3,332,612 | A | | 7/1967 | Gross |
| 3,382,862 | A | | 5/1968 | Math |
| 3,394,695 | A | | 7/1968 | Raymond |
| 3,394,876 | A | | 7/1968 | Eck |
| 3,407,995 | A | | 10/1968 | Kinsworthy |
| 3,481,321 | A | | 12/1969 | Reichelderfer |
| 3,491,550 | A | | 1/1970 | Cavis |
| 3,561,906 | A | | 2/1971 | Fermer |
| 3,619,088 | A | | 11/1971 | Bullock |
| 3,638,636 | A | | 2/1972 | Marshall et al. |
| 3,695,250 | A | | 10/1972 | Rohrs et al. |
| 3,746,464 | A | | 7/1973 | Goettl |
| 3,820,526 | A | | 6/1974 | Van Vliet |
| 3,846,040 | A | | 11/1974 | Dennis |
| 3,950,835 | A | | 4/1976 | Bennink et al. |
| 4,035,610 | A | | 7/1977 | Roth |
| 4,130,376 | A | | 12/1978 | Dietsche |
| 4,252,502 | A | | 2/1981 | Scheidel |
| 4,309,977 | A | | 1/1982 | Kitchen |
| 4,419,049 | A | | 12/1983 | Gerboth et al. |
| 4,424,006 | A | | 1/1984 | Armbruster |
| 4,603,680 | A | | 8/1986 | Dempsey et al. |
| 4,828,456 | A | | 5/1989 | Bodzian et al. |
| 4,917,572 | A | | 4/1990 | Van Houten |
| 5,141,397 | A | | 8/1992 | Sullivan |
| 5,257,904 | A | | 11/1993 | Sullivan |
| 5,301,654 | A | | 4/1994 | Weber, III et al. |
| 5,309,890 | A | | 5/1994 | Rieke et al. |
| 5,368,010 | A | | 11/1994 | Weber, III et al. |
| 5,370,106 | A | | 12/1994 | Beck et al. |
| 5,375,586 | A | | 12/1994 | Schumacher et al. |
| 5,377,662 | A | | 1/1995 | Mills et al. |
| 5,379,750 | A | | 1/1995 | Larsen et al. |
| 5,379,751 | A | | 1/1995 | Larsen et al. |
| 5,380,193 | A | | 1/1995 | Williams et al. |
| 5,406,933 | A | | 4/1995 | Lu |
| 5,427,503 | A | | 6/1995 | Haraga et al. |
| 5,448,986 | A | | 9/1995 | Christopher et al. |
| 5,551,836 | A | | 9/1996 | Roth et al. |
| 5,570,996 | A | * | 11/1996 | Smiley, III ..... F04D 29/4226 415/204 |
| 5,601,400 | A | | 2/1997 | Kondo et al. |
| 5,813,834 | A | | 9/1998 | Hopfensperger et al. |
| 6,273,679 | B1 | | 8/2001 | Na |
| 6,296,478 | B1 | | 10/2001 | Gatley, Jr. |
| 6,314,894 | B1 | | 11/2001 | Gatley, Jr. |
| 6,318,358 | B1 | | 11/2001 | Gatley, Jr. |
| 6,352,431 | B1 | | 3/2002 | Gatley, Jr. |
| 6,435,818 | B1 | | 8/2002 | Gatley, Jr. |
| 6,439,839 | B1 | | 8/2002 | Song et al. |
| 6,468,034 | B1 | | 10/2002 | Garrison et al. |
| 6,494,152 | B2 | | 12/2002 | Gatley, Jr. |
| 6,511,290 | B1 | | 1/2003 | Gatley, Jr. |
| 6,578,629 | B1 | | 6/2003 | Trent |
| 6,585,484 | B2 | | 7/2003 | Rosenthal et al. |
| 6,595,146 | B2 | | 7/2003 | Gatley, Jr. |
| 6,767,184 | B2 | | 7/2004 | Kim et al. |
| 6,821,088 | B2 | | 11/2004 | Sakai et al. |
| 6,895,874 | B2 | | 5/2005 | Gatley, Jr. |
| 6,902,373 | B1 | | 6/2005 | Glanton |
| 6,908,281 | B2 | | 6/2005 | Lyons et al. |
| 6,929,448 | B1 | | 8/2005 | Lyons et al. |
| 6,951,241 | B1 | | 10/2005 | Gatley |
| 6,953,319 | B2 | | 10/2005 | Sohn et al. |
| 7,144,219 | B2 | | 12/2006 | Hancock |
| 7,182,574 | B2 | | 2/2007 | Lyons |
| 7,210,903 | B2 | | 5/2007 | Lyons |
| 7,334,986 | B2 | | 2/2008 | Sohn et al. |
| 7,338,256 | B2 | | 3/2008 | Kuo et al. |
| 7,431,642 | B2 | | 10/2008 | Herbst |
| 7,500,825 | B2 | | 3/2009 | Hanai |
| 7,549,842 | B2 | | 6/2009 | Hanson et al. |
| 8,001,958 | B2 | | 8/2011 | Post |
| 8,025,049 | B2 | | 9/2011 | Post |
| 8,550,066 | B2 | | 10/2013 | Post |
| 8,591,183 | B2 | * | 11/2013 | Lyons ..... F04B 17/00 415/206 |
| 9,017,011 | B2 | | 4/2015 | Gatley, Jr. et al. |
| 2002/0009364 | A1 | | 1/2002 | Otsuka |
| 2002/0014233 | A1 | | 2/2002 | Gatley et al. |
| 2003/0012649 | A1 | | 1/2003 | Sakai et al. |
| 2004/0062646 | A1 | | 4/2004 | Nomura |
| 2004/0076516 | A1 | | 4/2004 | Bird |
| 2005/0201861 | A1 | | 9/2005 | Yoshida et al. |
| 2006/0034686 | A1 | | 2/2006 | Smiley et al. |
| 2006/0051205 | A1 | | 3/2006 | Platz |
| 2006/0165521 | A1 | | 7/2006 | Kim |
| 2007/0092373 | A1 | | 4/2007 | Chen et al. |
| 2007/0201976 | A1 | | 8/2007 | Higashida |
| 2007/0212218 | A1 | | 9/2007 | Seki et al. |
| 2007/0274833 | A1 | | 11/2007 | Sakai et al. |
| 2008/0267774 | A1 | | 10/2008 | Lian |
| 2008/0310957 | A1 | | 12/2008 | Lyons |
| 2009/0114206 | A1 | | 5/2009 | Post |
| 2009/0252605 | A1 | | 10/2009 | Lyons |
| 2010/0078007 | A1 | | 4/2010 | Post |
| 2011/0114073 | A2 | | 5/2011 | Post |
| 2011/0189005 | A1 | | 8/2011 | Post |
| 2011/0243720 | A1 | | 10/2011 | Post |
| 2013/0170945 | A1 | | 7/2013 | Gatley, Jr. et al. |
| 2014/0007859 | A1 | | 1/2014 | Post |

FOREIGN PATENT DOCUMENTS

| | | | |
|---|---|---|---|
| FR | 2534981 | A1 | 4/1984 |
| JP | 54-109611 | A | 8/1979 |
| JP | 55-148999 | A | 11/1980 |
| JP | 59-131799 | A | 7/1984 |
| JP | 61138900 | A | 6/1986 |
| JP | 1-177498 | A | 7/1989 |
| JP | 03-213699 | A | 9/1997 |
| JP | 2004143995 | A | 5/2004 |
| JP | 54-32806 | B2 | 3/2014 |
| RU | 901641 | B | 10/1982 |

* cited by examiner

EXTENDED LENGTH CUTOFF BLOWER

This patent application is a continuation of patent application Ser. No. 13/082,683 (incorporated herein by reference), filed Apr. 8, 2011, which is a continuation-in-part of patent application Ser. No. 12/099,384, filed on Apr. 8, 2008, which claims the benefit of provisional patent application No. 60/943,955, which was filed on Jun. 14, 2007.

BACKGROUND OF THE INVENTION

1. Field of the Invention

The present invention relates to air moving devices and, in particular, to centrifugal blowers which include impellers or fan wheels having forward curved blades that are used, for example, in modern gas furnace draft inducer applications.

2. Description of the Related Art

In high efficiency furnaces, standard chimney air-draw effects are not sufficient to assure the required air flow through the furnace heat exchangers, and therefore, modern high efficiency furnaces utilize draft inducer blowers to provide sufficient air flow through the heat exchangers of the furnace. These types of draft inducer blowers typically include impellers or fan wheels having forward curved blades. The impeller is rotated in a scroll shaped blower housing to draw an air flow through the housing. This, in turn, draws an air flow through the heat exchanger. Similarly, in other applications where air flow is produced by a centrifugal blower having forward curved blades, the ability of the blower to efficiently generate sufficient air flow and pressure are important. Also, in many applications in which centrifugal blowers are used, such as furnace draft inducers, for example, space is at a premium so minimization of the size of the blower is desired.

Centrifugal blowers convert static air pressure into velocity air pressure in the blower housing. Pressure conversion is accomplished in the blower housing as the cross section available for passage of the air flow expands around the periphery of the impeller from the cutoff to the outlet. FIG. 1 is a schematic representation of a typical prior art blower housing and impeller, and a graph showing the dimensional relationship of the impeller periphery IP and the scroll shaped length of the blower housing side wall SS. As shown in FIG. 1, the increase in cross section in the scroll portion of the blower housing around the impeller is proportional to the developed length of the impeller periphery. In particular, the angle between the developed scroll surface SS and the impeller periphery IP is called the expansion angle which, as shown in FIG. 1, is 7°. The impeller diameter and the expansion angle determine the overall width dimensions $W_1$-$W_1$ and $W_2$-$W_2$of the scroll length of the blower housing.

The effect of expansion angle on blower performance is shown in the pressure-flow curves in FIG. 2. The curves in FIG. 2 represent blower housing side walls having expansion angles of 4, 6, 8, 10, and 12 degrees. Flow rate increases significantly with increases in expansion angle at any constant static pressure between free flow (zero static pressure) at the bottom of each pressure-flow curve and the knee of the curve at the top. For example, at a static pressure of 30% of maximum, the air flow rate is only 40% of maximum for a 4° expansion angle but is 90% for a 10° expansion angle.

Expansion angle also effects performance of the blower in a particular system. As shown in FIG. 2, for example, the impeller in a blower housing having an 8° expansion angle delivers about 73% of the free flow air rate at operating point A on the given system resistance curve. If the expansion angle of the blower housing is increased to 10°, for a constant expansion angle scroll housing air delivery of the same impeller is increased to about 83% of free flow air at operating point B.

Although greater expansion angles improve blower performance, the relative amount of improvement gradually diminishes, and the size of the blower housing with respect to the diameter of the impeller becomes too large for space constraints in applications in which the blower is used. This is mostly due to the volume between the impeller periphery and the blower housing side wall too great to allow the high velocity stream coming off of the impeller to impact the air volume in the scroll. For example, if either of the overall width dimensions $W_1$-$W_1$ or $W_2$-$W_2$ of the blower housing is too large for the space available for the blower housing, a blower housing having a smaller expansion angle may be selected. Then, if the resulting reduction in air flow rate is not acceptable, a compromise must be made in either blower size or air performance.

One known blower assembly 10 is shown in FIGS. 3 and 4. This assembly 10 generally includes a blower housing 12 having a top wall or end wall 14 and a side wall 16 extending from top wall 14. The side wall 16 includes a flange 18 by which a cover member (not shown) may be secured to the side wall 16 such as by crimping or welding. The cover member typically includes a circular inlet opening (not shown). A motor 20 is attached to top wall 14 of blower housing 12 via suitable fasteners (not shown). An impeller 22 is attached to output shaft 24 of motor 20 and is positioned within the interior of blower housing 12. The impeller 22 is a "fan wheel," "squirrel cage" or "sirocco" type impeller, including a plurality of blades 26 which are curved forward with respect to the direction of air flow, indicated by arrow 28. Side wall 16 of blower housing 12 is generally curved or scrolled as described below, and defines a rectangular air outlet opening 30 to which a typical discharge structure (not shown) may be attached, for example, for connection to a circular discharge pipe via suitable clamps and/or fasteners. Cutoff 32 is defined by the end of the scroll shaped side wall 16 adjacent outlet opening 30.

As shown in FIG. 4, the output shaft 24 of the motor 20 and the center of impeller 22 are coaxial and disposed at a center point CP. Side wall 16 of blower housing 12 is scrolled such that its radius $R_1$, defined from center point CP to wall 16, continuously increases in length from cutoff 32 in a radial direction center point CP with respect to the direction of rotation of impeller 22 and the air flow direction along arrow 28. Thus, radius $R_1$ has a minimum length at cutoff 32 and a maximum length adjacent the end of the outlet opening 30 which is the cutoff 32.

In this manner, the side wall 16 of blower housing 12 is shaped to provide the blower housing 12 with a constantly expanding internal area between the impeller 22 and the side wall 16 around impeller 22 from the cutoff 32 toward the outlet opening 30 in order to allow constant expansion of the air flow area from impeller 22 toward outlet 30. However, in view of the considerations discussed above, the expansion angle of the blower housing 12 is typically only about 6° or less in order to minimize the overall width dimensions $W_1$-$W_1$ and $W_2$-$W_2$ of the blower housing.

What is needed is a blower housing which is an improvement over the foregoing.

SUMMARY OF THE INVENTION

The present invention provides a blower assembly including a blower housing having a side wall with a first portion extending from the initial cutoff through an angle of at least 45° or more, the first portion having a radius which is substantially constant or which increases at a substantially lesser rate than that employed in prior art blower housings. The side wall additionally includes a second portion, extending from the end of the first portion to the outlet, which has an increasing radius or a radius which increases at a relatively greater rate than that employed in prior art blower housings. In other words the expansion angle is increasing during the second portion, vs. the expansion angle being constant as in the prior art. The shape of the side wall allows a reduction in the overall size of the blower housing for a given sized impeller.

In one form thereof, the present invention provides a blower assembly, including a motor having a rotatable output shaft; an impeller mounted to the output shaft for rotation therewith, the impeller having a plurality of forward blades; and a blower housing having an inlet and an outlet, including a top wall, motor mounted to the top wall with the output shaft extending through an opening in the top wall; and a curved side wall extending from the top wall and defining an interior space in which the impeller is disposed, the side wall defining a cutoff adjacent the outlet and a point angularly spaced from the cutoff by at least 45°, side wall further having a radius from a center of the impeller that increases at a first rate from the cutoff to the point, and increases at a increasing expansion from the point to the outlet, the first rate giving the side wall a 3° expansion angle less between the cutoff and the point on the side wall.

In another form thereof, the present invention provides a blower assembly, including a motor having a rotatable output shaft; an impeller mounted to the output shaft for rotation therewith, the impeller having a plurality of forward curved blades; and a blower housing having an inlet and an outlet, including a top wall, the motor mounted to the top wall with the output shaft extending through an opening in the top wall; and a curved side wall extending from the top wall and defining an interior space in which the impeller is disposed, the side wall shaped to define a first expansion angle that is substantially constant from the cutoff through an angle, and a second expansion angle that increases from the angle to the outlet.

BRIEF DESCRIPTION OF THE DRAWINGS

The above-mentioned and other features and advantages of this invention, and the manner of attaining them, will become more apparent and the invention itself will be better understood by reference to the following description of the embodiments of the invention taken in conjunction with the accompanying drawings, wherein.

Corresponding reference characters indicate corresponding parts throughout the several views. The examples set out herein illustrate preferred embodiments of the invention, and such examples are not to be construed as limiting the scope of the invention in any manner.

DETAILED DESCRIPTION

Figure 5:
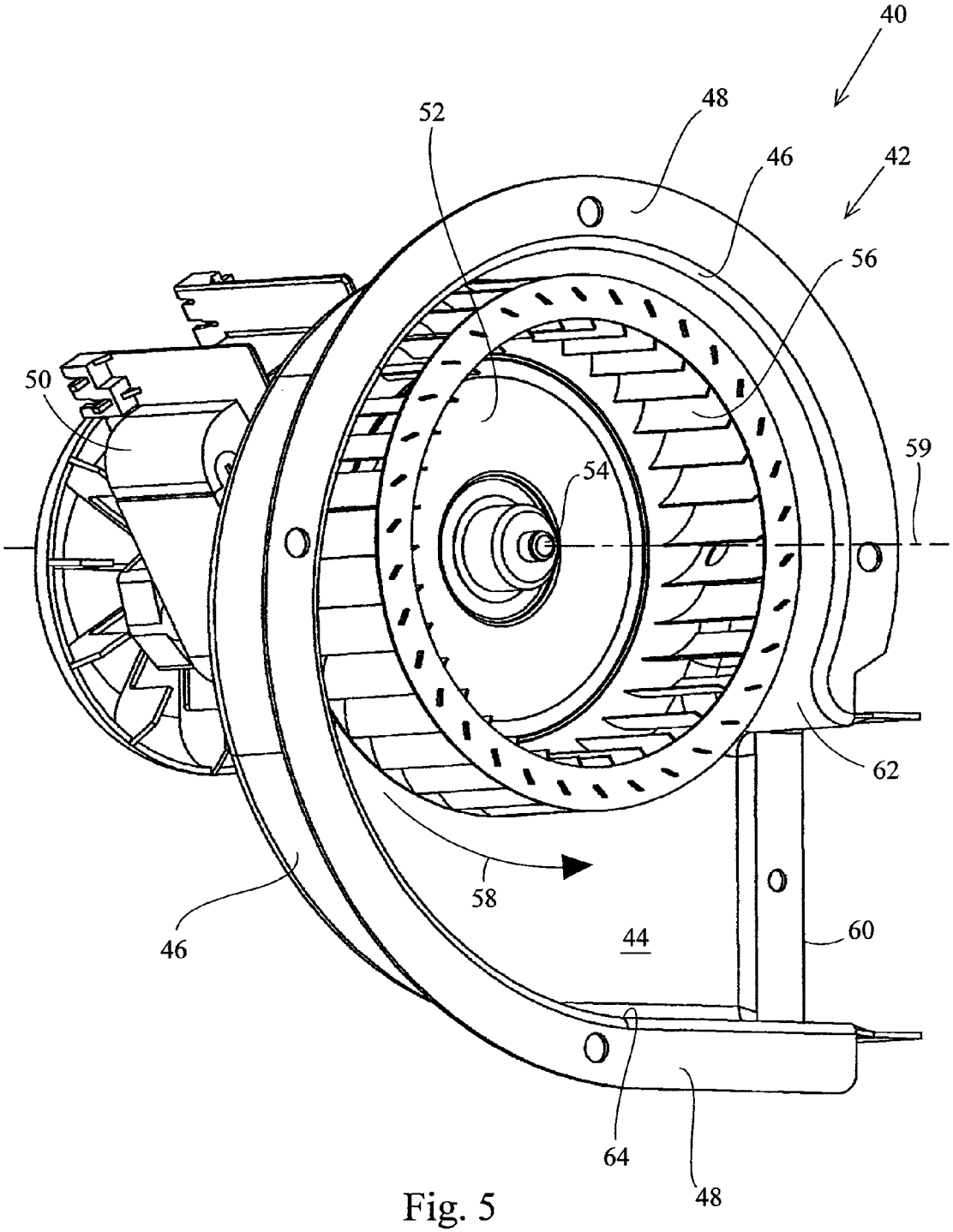
FIG. 5 is a partial perspective view of a blower assembly in accordance with the present invention.
Figure 6:
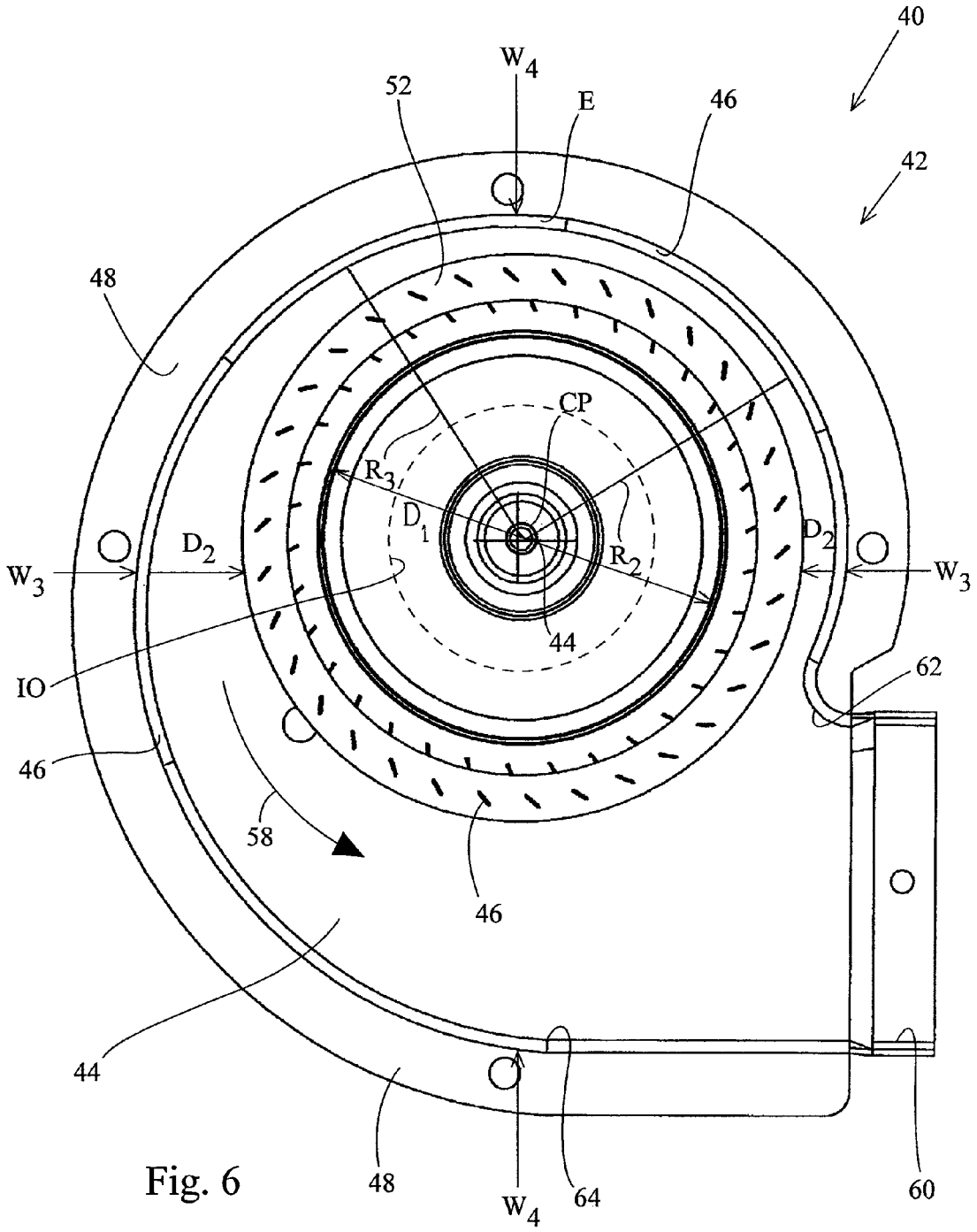
FIG. 6 is an end view of the blower assembly of FIG. 5.
Figure 7:
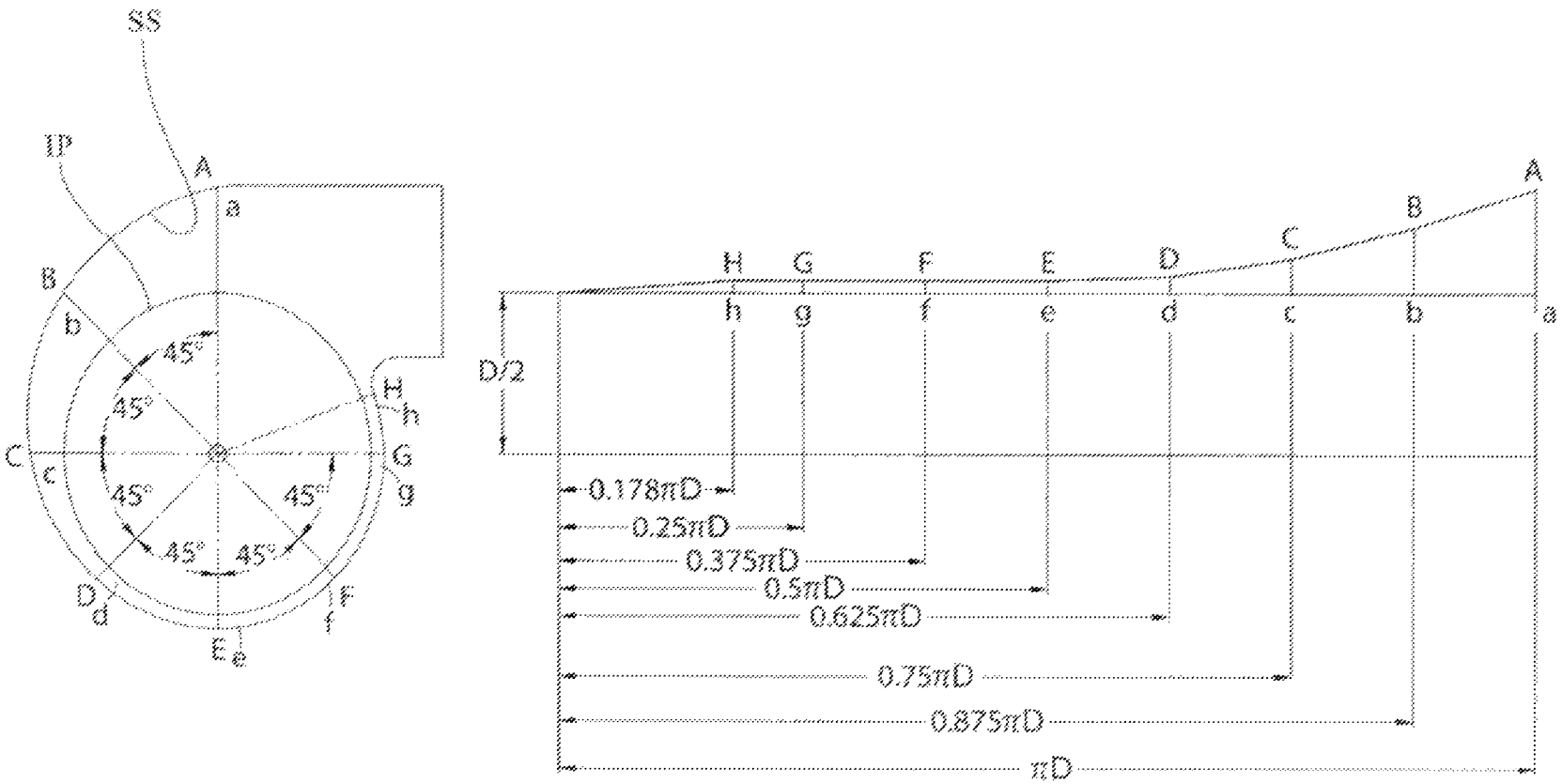
FIG. 7 is a schematic representation and a chart illustrating the expansion angle of the present invention blower housing of FIGS. 5 and 6.

Referring to FIGS. 5-7, the blower assembly 40 of the present invention is shown. The assembly includes a blower housing 42 that may be made from stamped metal components, for example, or from suitable rigid plastics. Blower housing 42 includes a top wall or end wall 44 and a side wall 46 extending from the top wall 44. The side wall 16 includes a flange 48 by which a cover member (not shown) may be secured to side wall 46 such as by separate mechanical fasteners, by crimping or welding, for example. The cover member also includes a circular inlet opening IO represented by dashed lines in FIG. 6.

A motor 50 is supported on the end wall 44 of blower housing 42 via fasteners (not shown) or some other equivalent connection. An impeller or fan wheel 52 is attached to output shaft 54 of motor 50 and is positioned within the interior of blower housing 42. Similar to blower housing 12 described above, impeller 52 is a "squirrel cage" or "sirocco" type impeller, including a plurality of forward-curved blades 56 with respect to the rotation direction of the impeller and of air flow, indicated by arrow 58. The impeller or fan wheel 52 has an inner dimension D1 and an outer diameter dimension D2. The output shaft 45 and impeller 52 rotate in the rotation direction 58 around a rotation axis 59. The rotation axis 59 defines mutually perpendicular axial and radial directions relative to the blower assembly 40. As can be seen in FIG. 6, the fan wheel inner dimension D1 is distinctly larger than the inner diameter dimension of the blower housing inlet opening IO. As can be seen in FIG. 5, the fan wheel 52 inner D1 outer D2 diameter dimensions are distinctly larger than the axial width dimension of the fan. As can be seen in FIGS. 5 and 6, there are no obstructions inside the 52 radially between the motor output shaft 59 and the plurality of fan blades 56 surrounding the shaft. This enables an unobstructed flow of air axially through blower housing inlet opening IO into the interior of the fan 52, then radially from motor output shaft 54 to the fan blades 56 and through the fan blades 56 around the entire fan wheel 52 to the blower housing side wall 46.

Side wall 46 of blower housing 42 is generally curved or scrolled as described below and, together with the end wall 44 and optionally the cover member, defines a rectangular air outlet opening 60 to which a typical discharge structure (not shown) may be attached for connection to a circular discharge pipe via suitable clamps and/or fasteners. A cutoff 62 is defined by a first end of the scroll shaped length of the side wall 46 adjacent outlet 60.

Blower assembly 40 may include one or more additional features such as those of the blower assemblies disclosed in U.S. Pat. Nos. 6,908,281, 7,182,574, and 7,210,903, and U.S. Patent Application Publication No. 2006/0051205, assigned to the assignee of the present invention, the disclosures of which are expressly incorporated herein by reference.

As shown in FIGS. 5 and 6, the output shaft 54 of motor 50 and the center impeller 52 are coaxial and are disposed at center point CP, which is aligned with the center of the circular inlet opening IO of blower housing 42. The side wall 46 the blower housing has a scroll shaped length that extends from the cutoff by the first end 62 of the scroll-shaped length, in the rotation direction 58 around the impeller 52 to a second end 64 of the scroll shaped length. From the second end 64 the side wall 46 extends generally straight to the air outlet opening 60 of blower housing 42. The scroll shaped length of the side wall 46 has a first and a second portion between the first end 62 and second end 64. The first of the side wall length has a radius $R_2$. The side wall length first portion begins at the cutoff defined by the first end 62, and extends in the rotation direction around the impeller or fan wheel 52. The side wall length first portion extends from the end 62 through an arc of at least 45°, to an arc of at most 120°. Stated the side wall length first portion extends from the first end 62 of the side wall in the rotation direction 58 around the impeller 52 and subtends an angle at the rotation axis 59 of at least 45°, and at most 120°. In one embodiment, the first portion of the side wall length has a radius $R_2$ that is constant through the entire first portion of the side wall length. In a further embodiment, the first portion of side wall length has a radius $R_2$ that increases at a rate that gives the first portion the side wall length an expansion angle of at most 3°. In a still further the first portion of the side wall length has a radius $R_2$ that initially gives the first portion of the side wall length a decreasing expansion angle, and thereafter gives the first portion of the side wall length a constant expansion angle. However, in preferred embodiment of the invention, the first portion of the side wall length has radius $R_2$ that is constant, giving the first portion of the side wall length an expansion angle of 0° through an arc of 120° from the first end 62 of the side wall length. As shown in FIG. 6, the first portion of the side wall length extends through the arc of 120° from the first end cutoff 62 to a point E which is approximately 120° from the cutoff 62. The first portion of the side wall length the first end cutoff 62 to the point E on the side wall subtends an angle of 120° at the rotation axis 59. Thereafter, beginning at point E, side wall 46 includes a second portion having a radius $R_3$ that increases at a increasing expansion angle rate from point E to the second end 64 of the side wall scroll shaped length.

This differs from the known blower housing 12 in that any significant air flow expansion area does not begin immediately at cutoff 62, but begins after the transition point E on the side wall. The side wall is a continuous curve as it extends from the first portion of the side wall and crosses the transition point E to the second portion of the side wall. As the second portion of the side wall then continues to extend around the blower housing it still extends as part of a continuous curve from the cutoff 62 to the second end 64 of the side wall. The air flow expansion area of the second portion of the side wall expands gradually at first, and then more aggressively as shown in FIG. 7. Once the expansion does begin aggressively, the expansion does not increase at a constant expansion angle, but rather at an increasing expansion angle.

In other words, referring to the schematic representation of the blower housing side wall 46 and to the chart shown in FIG. 7, the present blower housing has a side wall or developed scroll surface SS which, from the cutoff at point H in clockwise rotation direction to point E, through an arc or subtended angle of approximately 120°, has a substantially constant radius and, beginning at point has a substantially increasing radius to provide an increasing expansion angle which is graphically depicted by the curved line from E to A in the chart. This increasing expansion angle creates additional power from the blower by increasing the velocity through a smaller portion of the impeller blades. This the impeller through the Coriolis effect and greatly increasing the blower's power a smaller package. In other words, in the present blower housing, the expansion angle is "delayed", or begins downstream from the cutoff rather than immediately after the cutoff as in known blower housings, and then expands aggressively in a increasing expansion angle method.

As shown in FIGS. 6, the side wall 46 developed scroll surface SS is a continuous curve as the side wall 46 extends along the first portion of the side wall length through the transition point E on the side wall 46 and then along the second portion of the side wall length. There is no sudden expansion or abrupt change in the side wall expansion angle at the transition point E between the first portion of the side wall length and the second portion of the side wall length that could create turbulence and noise in the air flow through the blower housing that would require additional features in the blower housing to control the air flow in the area of the abrupt change to reduce the noise produced at that area.

In operation of the blower assembly 40 with the impeller or fan wheel 52 rotating in the blower housing 42 in the rotation direction 58 shown in FIGS. 5 and 6, air is drawn through the inlet opening IO and into the interior of the impeller or fan wheel 52. There are no obstructions of the blower housing 42 in the interior of the fan wheel 52 and therefore there is an unobstructed flow of air from the area of the motor output shaft 54 in the interior of the fan wheel 52, through the fan blades 56 around the interior of the fan wheel 52, and to the side wall 46 of the blower housing from the cutoff 62, around the first portion and the second portion of the side wall length, and to the second end 64 of the side wall length and the outlet opening 60 of the blower housing.

As discussed above, increasing the expansion angle of a blower housing increases the performance and efficiency of blowers having forward curved impellers. Furthermore, having the expansion angle to increase as it proceeds toward the outlet further increases power and performance. However, because expansion angles of greater than about 7° result in excessively large blower housings, engineers have been willing to accept lower efficiency and performance to keep prior art blower housing sizes to a manageable size. The present inventor has found that the blower housing disclosed herein, having a side wall with a first portion extending from the initial cutoff through an angle of at least 45° or more, the first portion having a radius which is substantially constant or which increases at a relatively lesser rate, and then after this portion the housing side wall having a gradual continuous transition to a second portion having an increasing expansion angle that increases in a greater than linear fashion without any sudden expansion or abrupt change in the side wall expansion angle outperforms known blower housings of similar size having an expansion angle beginning immediately after the cutoff.

Figure 1:
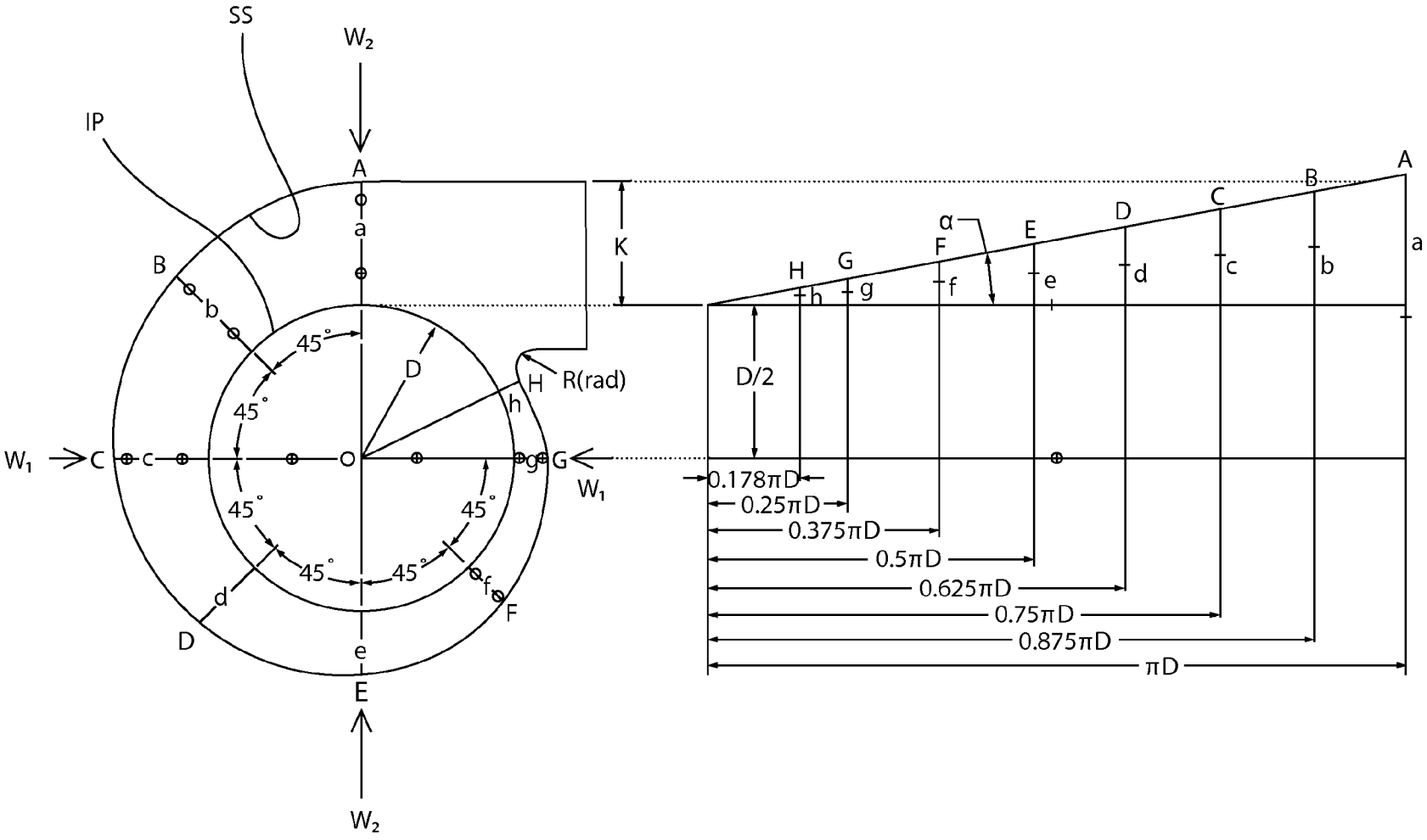
FIG. 1 Prior Art
FIG. 1 is a schematic representation and a chart illustrating the constant expansion angle of a known blower housing.
Figure 2:
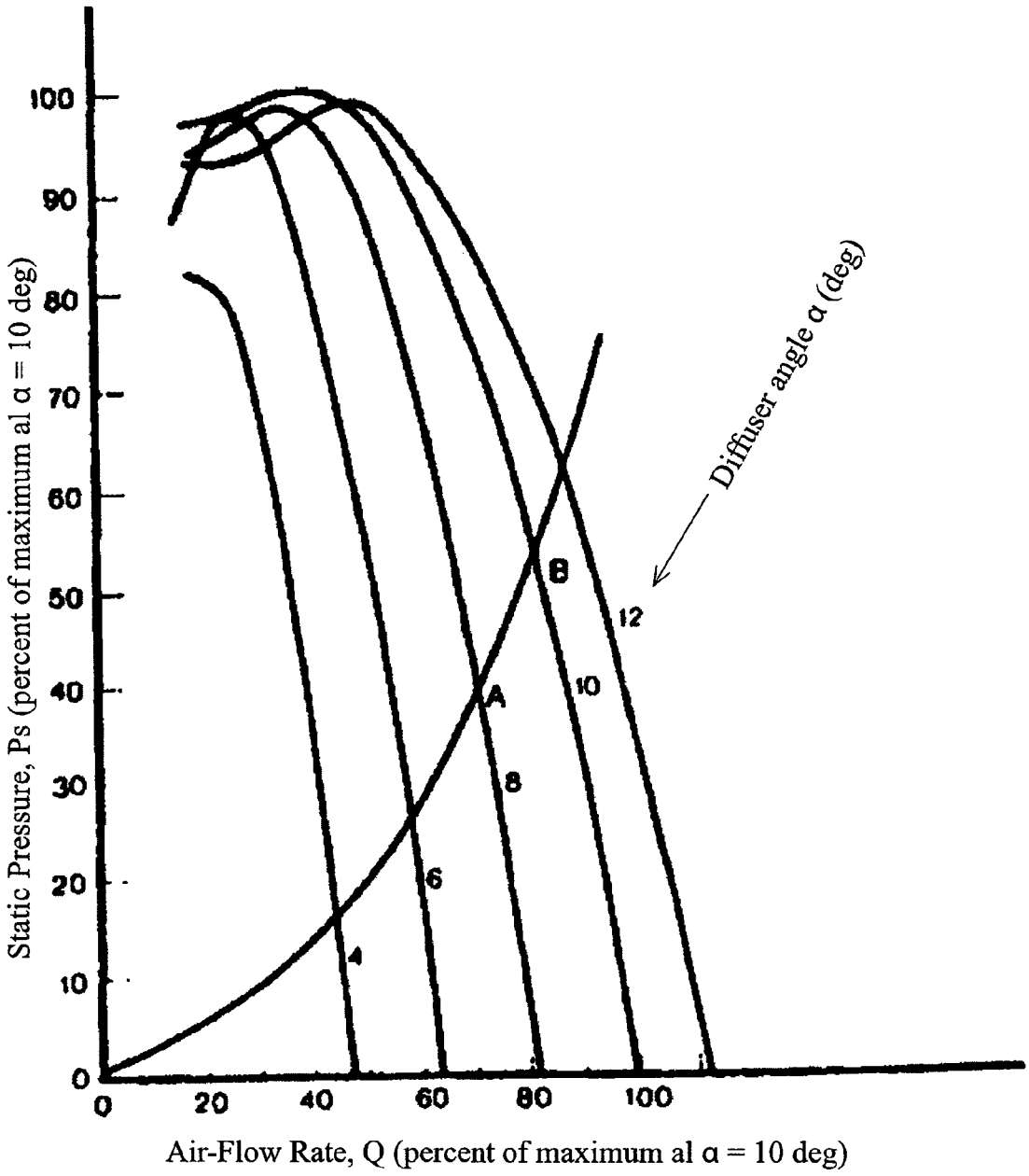
FIG. 2 is a graph of air flow rate vs. static pressure for blower housings having different but constant expansion angles.
Figure 3:
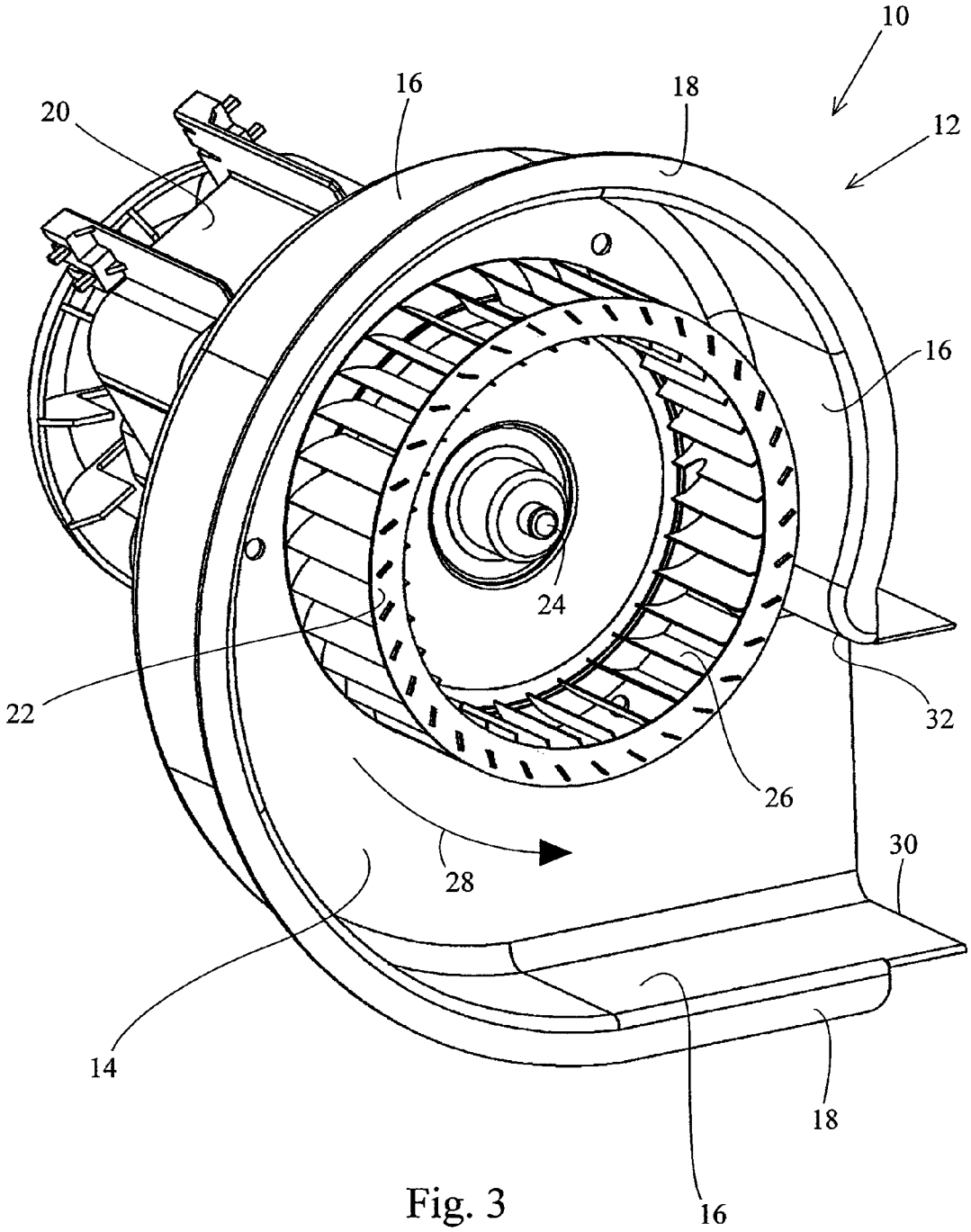
Fig. 3 Prior Art
FIG. 3 is a partial perspective view of a known blower assembly.
Figure 4:
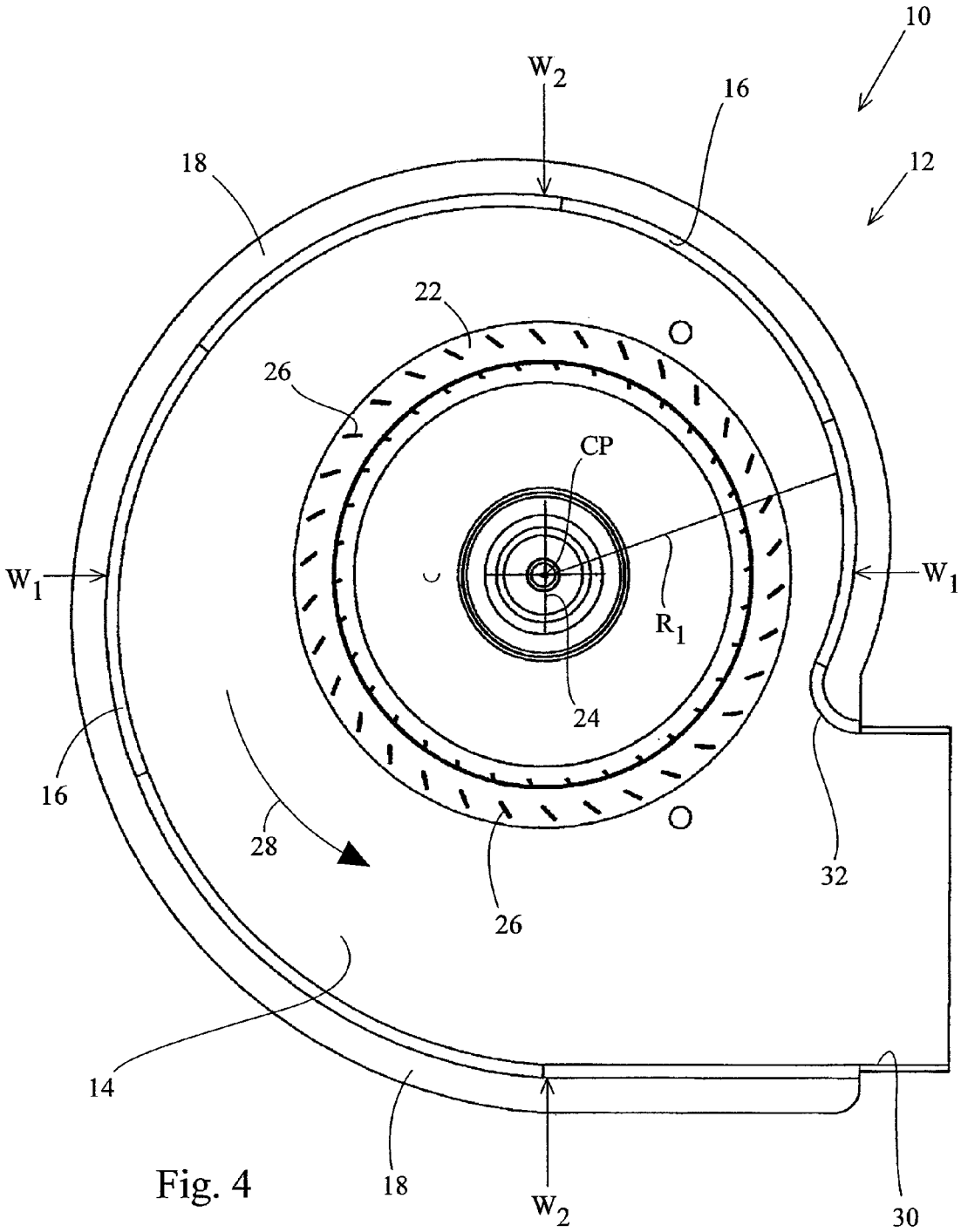
Fig. 4 Prior Art
FIG. 4 is an end view of the blower assembly of FIG. 3.

Further, the foregoing shape of side wall 46 of blower housing 42 allows the overall size or profile of blower housing 42 to be reduced, thereby reducing the materials and cost of manufacturing of the blower housing 42 as compared to the prior art blower housing 12 of FIGS. 1 and 2. For example, a pair of perpendicular width dimensions $W_3$-$W_3$ and $W_4$-$W_4$ of blower housing 42, shown in FIG. 6, which each pass through center point CP with width dimension $W_3$-$W_3$ parallel to the direction of outlet 60, are smaller than the pair of corresponding width dimensions $W_1$-$W_1$ and $W_2$-$W_2$ of the prior art blower housing 12 of FIG. 4. In one embodiment, width dimension $W_3$-$W_3$ of the blower housing 42 of the invention is approximately 6.8 inches, while width dimension $W_1$-$W_1$ of the prior art blower housing 12 is approximately 8.0 inches, and width dimension $W_4$-$W_4$ of the blower housing 42 of the invention is approximately 7.8 inches, while width dimension $W_2$-$W_2$ of the prior art blower housing 12 is approximately 8.9 inches, with blower housings 12 and 42 having the same size impeller.

In a still further embodiment, side wall 46 of blower housing 42 may include a first portion of the scroll shaped length, beginning at cutoff 62, having a radius that initially decreases slightly through an initial arc or subtended angle of about 45°, for example, and is then substantially constant through the remainder of the first portion of the side wall length. In this manner, side wall 46 of blower housing 42 would have an initially decreasing radius portion immediately from cutoff 62, followed by a substantially constant radius portion and thereafter, may have an increasing expansion angle radius portion toward outlet 60 of blower housing 42 to provide an air flow expansion area. Similar to the embodiment shown in FIGS. 5 and 6, this embodiment also allows for a reduction in the overall size of the blower for an impeller of a given size.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blower assembly comprising:

a motor having a rotor, the rotor being rotatable in a rotation direction around a rotation axis, the rotation axis defining mutually perpendicular axial and radial directions relative to the blower assembly;

an impeller operatively coupled to the rotor in a manner to rotate with the rotor, the impeller having a plurality of blades that surround an interior of the impeller; and a blower housing with an air inlet opening and an air outlet opening, the air inlet opening being generally aligned with the impeller and the rotation axis, the blower housing having a side wall that surrounds the impeller and defines an interior of the blower housing, the blower housing and the impeller being arranged and configured to permit air to flow through the air inlet opening and into the interior of the blower housing and into the interior of the impeller and from the interior of the impeller through the plurality of fan blades surrounding the interior of the impeller to the blower housing side wall, the side wall having a first end that defines a cutoff adjacent the air outlet opening and a point on the side wall that is spaced in the rotation direction from the cutoff by an arc of at least 45°, the side wall being a radial distance from the rotation axis that is substantially constant as the side wall extends from the cutoff to the point on the side wall and increases at a rate as the side wall extends in the rotation direction away from the point on the side wall toward the air outlet opening, the rate defining an increasing expansion angle of the side wall, and the side wall being a continuous curve as the side wall extends in the rotation direction from the cutoff through the point on the side wall and toward the air outlet opening.

2. The blower assembly of claim 1, further comprising:

the air inlet opening being circular and having an inner diameter dimension that is smaller than an inner diameter dimension of the plurality of blades surrounding the impeller interior.

3. The blower assembly of claim 1, further comprising:

the impeller having an axial width dimension that is smaller than an exterior diameter dimension of the impeller.

4. The blower assembly of claim 1, further comprising:

the point on the side wall being spaced in the rotation direction from the cutoff by an arc of at most 120°.

5. The blower assembly of claim 4, further comprising:

the radial distance of the side wall from the axis of rotation increasing at the rate as the side wall extends in the rotation direction from the point on the side wall through an arc of at least 180°.

6. A blower assembly comprising:

a motor having a rotor, the rotor being rotatable in a rotation direction around a rotation axis, the rotation axis defining mutually perpendicular axial and radial directions relative to the blower assembly;

an impeller operatively coupled to the rotor in a manner to rotate with the rotor, the impeller having a plurality of blades that surround an interior of the impeller; and a blower housing with an air inlet opening and an air outlet opening, the air inlet opening being generally aligned with the impeller and the rotation axis, the blower housing having a side wall that surrounds the impeller and defines an interior of the blower housing, the blower housing and the impeller being arranged and configured to permit air to flow through the air inlet opening into the interior of the blower housing and the interior of the impeller and from the interior of the impeller through the plurality of fan blades surrounding the interior of the impeller to the blower housing side wall, the side wall having a side wall length that extends in the rotation direction from a first end that defines a cutoff adjacent the air outlet opening, around the impeller to a second end on an opposite side of the air outlet opening from the first end, the side wall length having a first portion that extends in the rotation direction from the cutoff to a point on the side wall where the first portion of the side wall length subtends an angle of at least 45° at rotation axis, the side wall length having a second portion that extends in the rotation direction from the point on the side wall to the second end, the radial distance from the rotation axis to the side wall being substantially constant generally along the entirety of the side wall first portion and the radial distance from the rotation axis to the side wall increasing at a gradually increasing rate generally along the side wall second portion as the second portion extends from the point on the side wall to the second end, and the side wall being a continuous curve as the side wall extends in the rotation direction through the first portion of the side wall length, the point on the side wall and the second portion of the side wall length.

7. The blower assembly of claim 6, further comprising:

the air inlet opening being circular and having an inner diameter dimension that is smaller than an inner diameter dimension of the plurality of blades surrounding the impeller interior.

8. The blower assembly of claim 7, further comprising:

the impeller having an axial width dimension that is smaller than an exterior diameter dimension of the impeller.

9. The blower assembly of claim 6, further comprising:

the motor having an output shaft that is rotatable in a rotation direction around a rotation axis.

10. The blower assembly of claim 7, further comprising:

the blower housing having an end wall with a shaft opening, the output shaft of the motor extending through the shaft opening.

11. A blower assembly comprising:

a motor having a rotor, the rotor being rotatable about an axis of rotation in a rotation direction, the axis of rotation defining mutually perpendicular axial and radial directions relative to the blower assembly;

an impeller operatively coupled to the rotor in a manner to rotate with the rotor, the impeller having a plurality of fan blades that extend axially across the impeller and surround an interior of the impeller; and a blower housing having an interior containing the impeller, a circular air inlet opening that is coaxial with the impeller, and an outlet opening, the blower housing and the impeller being arranged and configured to permit air to flow through the air inlet opening into the interior of the blower housing and the interior of the impeller and from interior of the impeller through the plurality of fan blades surrounding the interior of the impeller, and the blower housing having a side wall that extends axially relative to the impeller and has a side wall length that extends in the rotation direction from a first cutoff end of the side wall at one side of the blower housing outlet opening, around the impeller to a second end of the side wall on an opposite side of the blower housing opening from the first end, the side wall having a first portion that extends from the first cutoff end in the rotation direction and subtends an angle of at least 45° at the axis of rotation, the side wall first portion being a radial distance from the axis of rotation that is substantially constant as the first portion extends in the rotation direction from the first cutoff end and the side wall having a second portion that forms a continuous curve with the side wall first portion and extends from the first portion in the rotation direction to the side wall second end, the side wall second portion being a radial distance from the axis rotation that increases at an increasing rate as the side wall second portion extends in the rotation direction from the side wall first portion to the side wall second end, the rate defining an increasing expansion angle of the side wall second portion.

12. The blower assembly of claim 11, further comprising:

the air inlet opening having an inner diameter dimension that is smaller than an inner diameter dimension of the impeller plurality of fan blades.

13. The blower assembly of claim 12, further comprising:

the impeller having an outer diameter dimension that is larger than an axial width dimension of the impeller.

14. A blower assembly comprising:

a motor having a rotor, the rotor being rotatable in a rotation direction around a rotation axis, the rotation axis defining mutually perpendicular axial and radial directions relative to the blower assembly;

an impeller operatively coupled to the rotor in a manner to rotate with the rotor, the impeller having a plurality of blades surrounding an interior of the impeller; and a blower housing with an air inlet opening and an air outlet opening, the blower housing having a side wall surrounding the impeller and defining an interior of blower housing, the blower housing and the impeller being arranged and configured to permit air to flow through the air inlet opening and into the interior of the blower housing and into the interior of the impeller and from the interior of the impeller through the plurality of fan blades surrounding the interior of the impeller to the blower housing side wall, the side wall having a side wall length that extends in the rotation direction a first end of the side wall length that defines a cutoff adjacent the air outlet opening of blower housing, around the impeller to a second end of the side wall length adjacent the air outlet opening on an opposite side of the air outlet opening from the first end, the wall length having a first portion that extends in the rotation direction from the first end a point on the side wall length where the first portion of the side wall length subtends an angle of at least 45° at the rotation axis, the side wall length having a second portion forms a continuous curve with the first portion of the side wall length and extends in the rotation direction from the first portion of the side wall length to the second end of the wall length, the first portion of the side wall length having no expansion angle as the first portion of the side wall length extends in the rotation direction from the first end of the wall length to the point on the side wall, and the second portion of the side wall length having a gradually increasing expansion angle from the no expansion angle of the first portion of the side wall length as the second portion of the side wall length extends in rotation direction from the first portion of the side wall length to the second end of the wall length.

15. The blower assembly of claim 14, further comprising:

the air inlet opening being circular and having an inner diameter dimension that is smaller than an inner diameter dimension of the plurality of blades surrounding the impeller interior.

16. The blower assembly of claim 15, further comprising:

the impeller having an axial width dimension that is smaller than an exterior diameter dimension of the impeller.

17. A blower assembly comprising:

a motor having a rotor, the rotor being rotatable in a rotation direction around a rotation axis, the rotation axis defining mutually perpendicular axial and radial directions relative to the blower assembly;

an impeller operatively coupled to the rotor in a manner to rotate with the rotor, the impeller having a plurality of blades surrounding an interior of the impeller; and a blower housing with an air inlet opening and an air outlet opening, the blower housing having a side wall surrounding the impeller and defining an interior of blower housing, the blower housing and the impeller being arranged and configured to permit air to flow through the air inlet opening into the interior of the blower housing and into the interior of the impeller and from the interior of the impeller through the plurality fan blades surrounding the interior of the impeller to the blower housing side wall, the wall having a side wall length that extends in the rotation direction from a first end the side wall length that defines a cutoff adjacent the air outlet opening of the blower housing, around the impeller to a second end of the side wall length adjacent the air opening on an opposite side of the air outlet opening from the first end, the side wall length having a first portion that extends in the rotation direction from the first end to a point on the side wall length where the first portion of the side wall length subtends an angle of at least 45° at the rotation axis, the side wall length having a second portion forms a continuous curve with the first portion of the side wall and extends in the direction from the first portion of the side wall length to the second end of the side wall length, the first portion of the side wall length being spaced a constant radial distance from the rotation axis as the first portion of the side wall length extends in the rotation direction from the first end of the side wall length to the point on the side wall length, the second portion of the side wall length being spaced a radial distance from the axis that gradually increases from the constant radial distance of the first portion of the side wall length and increases at an increasing rate as the second portion of the side wall length extends in the rotation direction from the point on the side wall length to the end of the side wall length.

18. The blower assembly of claim 17, further comprising: the air inlet opening being circular and having an inner diameter dimension that is smaller than an inner diameter dimension of the plurality of blades surrounding the impeller interior.

19. The blower assembly of claim 17, further comprising: the impeller having an axial width dimension that is smaller than an exterior diameter dimension of the impeller.

* * * * *